United States Patent [19]

Ricketts

[11] 4,290,649

[45] Sep. 22, 1981

[54] METHOD FOR EXPLOSIVELY EXPANDING A PILLAR FOR FORMING AN IN SITU OIL SHALE RETORT

[75] Inventor: Thomas E. Ricketts, Grand Junction, Colo.

[73] Assignee: Occidental Oil Shale, Inc., Grand Junction, Colo.

[21] Appl. No.: 92,173

[22] Filed: Nov. 7, 1979

[51] Int. Cl.[3] ..... E21C 41/10

[52] U.S. Cl. ..... 299/2; 102/311; 299/13; 166/259

[58] Field of Search ..... 299/2, 13; 102/23; 166/259, 299

[56] References Cited

U.S. PATENT DOCUMENTS

| | | | |
|---|---|---|---|
| 3,316,020 | 4/1967 | Bergstrom | 299/2 |
| 3,434,757 | 3/1969 | Prats | 299/2 |
| 3,661,423 | 5/1972 | Garrett | 299/2 |
| 3,917,346 | 11/1975 | Janssen | 299/13 |
| 3,980,339 | 9/1976 | Heald et al. | 299/2 |
| 4,043,597 | 8/1977 | French | 299/2 |
| 4,043,598 | 8/1977 | French et al. | 299/2 |
| 4,146,272 | 3/1979 | French | 299/2 |
| 4,153,298 | 10/1979 | McCarthy et al. | 299/2 |

*Primary Examiner*—Ernest R. Purser

*Attorney, Agent, or Firm*—Christie, Parker & Hale

[57] ABSTRACT

An in situ oil shale retort is formed in a subterranean formation containing oil shale, a horizontally extending void is excavated within the boundaries of the retort site leaving a zone of unfragmented formation above and/or below such a void, at least one pillar of unfragmented formation is left within the side boundaries of such a void for providing temporary support for overburden above the void, such a pillar is explosively expanded so that a principal portion of the pillar fragments travel to the side boundaries of the void and such a zone of unfragmented formation is explosively expanded toward the void. Accumulation of sufficient pillar fragments adjacent the side boundaries of the retort can substantially offset a tendency for fragments of the expanded zone of formation to form a mound thereby forming a fragmented permeable mass of formation particles within the retort with a reasonably flat upper surface. Such a fragmented permeable mass is retorted in situ to produce shale oil.

44 Claims, 6 Drawing Figures

METHOD FOR EXPLOSIVELY EXPANDING A PILLAR FOR FORMING AN IN SITU OIL SHALE RETORT

BACKGROUND OF THE INVENTION

This invention concerns a technique for forming a fragmented permeable mass of particles in an in situ oil shale retort and in particular relates to explosive expansion of pillars within voids excavated within the retort site before explosive expansion of adjacent formation containing oil shale.

The presence of large deposits of oil shale in the Rocky Mountain region of the United States has given rise to extensive efforts to develop methods for recovering shale oil from kerogen in the oil shale deposits. It should be noted that the term "oil shale" are used in the industry is, in fact, a misnomer, it is neither shale nor does it contain oil, it is a sedimentary formation comprising marlstone deposit with layers containing an organic polymer called "kerogen" which, upon heating, decomposes to produce liquid and gaseous products. It is the formation containing kerogen that is called "oil shale" herein and the liquid hydrocarbon product is called "shale oil".

A number of methods have been proposed for processing oil shale which involve either first mining the kerogen-bearing shale and processing the shale on the ground surface or processing the shale in situ. The latter approach is preferable from the standpoint of environmental impact since the treated shale remains in place, reducing the change of surface contamination and the requirement for disposal of solid wastes.

The recovery of liquid and gaseous products from oil shale deposits has been described in several patents such as U.S. Pat. Nos. 3,661,423; 4,043,597; 4,043,598; and 4,153,298, as well as pending applications including U.S. patent application Ser. No. 929,250, filed July 31, 1978, by Thomas E. Ricketts, now U.S. Pat. No. 4,192,554 and U.S. patent application Ser. No. 070,319, filed Aug. 27, 1979, by Chang Yul Cha, entitled TWO-LEVEL, HORIZONTAL FREE FACE MINING SYSTEM FOR IN SITU OIL SHALE RETORTS. Each of these applications and patents is assigned to Occidental Oil Shale, Inc., assignee of this application, and each is incorporated herein by this reference.

These patents and applications describe in situ recovery of liquid and gaseous hydrocarbon materials from a subterranean formation containing oil shale, wherein such formation is explosively expanded to form a stationary fragmented permeable mass of formation particles containing oil shale within the formation, referred to herein as an in situ oil shale retort, or merely as a retort. Retorting gases are passed through the fragmented mass to convert kerogen contained in the oil shale to liquid and gaseous products, thereby producing retorted oil shale. One method of supplying hot retorting gases used for converting kerogen contained in the oil shale as described in U.S. Pat. No. 3,661,423, includes establishing a combustion zone in the retort and introducing an oxygen-supplying retort inlet mixture into the retort to advance the combustion zone through the fragmented mass. In the combustion zone oxygen from the retort inlet mixture is depleted by reaction with hot carbonaceous materials to produce heat, combustion gas and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbons, and a residual carbonaceous material.

The liquid products and the gaseous products are cooled by the cooler oil shale fragments in the retort on the advancing side of the retorting zone. The liquid hydrocarbon products together with water produced in or added to the retort collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition and any gaseous retort inlet mixture that does not take part in the combustion process.

U.S. Pat. Nos. 4,043,597 and 4,043,598, and application Ser. No. 929,250, disclose methods for explosively expanding formation containing oil shale toward horizontal free faces to form a fragmented mass in an in situ oil shale retort. According to such a method a plurality of vertically spaced apart voids of similar horizontal cross section are initially excavated one above another within the retort site. A plurality of vertically spaced apart zones of unfragmented formation are temporarily left between the voids. Explosive is placed in each of the unfragmented zones and detonated to explosively expand each unfragmented zone upwardly and/or downwardly towards the void or voids above and/or below it to form a fragmented mass having an average void volume about equal to the void volume of the initial voids. Retorting of the fragmented mass is then carried out to recover shale oil from the oil shale.

U.S. patent application Ser. No. 070,319 discloses a method for explosively expanding formation containing oil shale towards a horizontal free face to form a fragmented mass in an in situ oil shale retort. According to such a method, a void having a horizontal cross section similar to the horizontal cross section of the retort being formed is initially excavated. A plurality of vertically spaced apart zones of unfragmented formation are left above the void. Explosive is placed in each of the unfragmented zones and detonated for explosively expanding such zones towards the void to form a fragmented mass in the retort having an average void volume about equal to the void volume of the initial void. The overlying zones can be expanded towards the void in a single round or a plurality of rounds. Retorting of the fragmented mass is then carried out to recover shale oil from the oil shale.

U.S. Pat. No. 4,153,298 describes a method for forming a retort by excavating at least one horizontally extending void adjacent a zone of unfragmented formation to be expanded. At least one support pillar of unfragmented formation is left in the void for supporting overburden. Explosive is placed in the zone of unfragmented formation and in such a support pillar. Explosive in such a pillar and in the zone of unfragmented formation is detonated in a single round of explosions with a time delay between detonation of explosive in such a pillar and detonation of explosive in the zone of unfragmented formation for first expanding such a pillar toward the void and then expanding unfragmented formation toward the void. The time delay is sufficient for creation of a free face at the juncture of such a pillar and the zone of unfragmented formation. The time delay is short enough that explosive in the zone of unfragmented formation is detonated before particles formed by explosive expansion of the pillars have come to rest on the floor of the void.

It is desirable to have a generally uniformly distributed void fraction in the fragmented mass so that there is generally uniform permeability. Thus, oxygen supplying gas and combustion gas can flow reasonably uniformly through the fragmented mass during retorting operations. A fragmented mass having generally uniform permeability avoids bypassing portions of the fragmented mass by retorting gas as can occur if there is gas channelling through the mass due to non-uniform permeability.

Is is also desirable that the fragmented permeable mass in a retort have a reasonably flat upper surface near or in contact with overlying unfragmented formation. It is preferable to maintain a resonably flat and horizontal combustion zone advancing through the fragmented mass in the retort during retorting. Establishment of such a flat combustion zone is significantly simplified when the upper surface of the fragmented mass is reasonably flat and horizontal.

Thus, in summary, it is desirable to provide a fragmented mass in a retort having reasonable uniformity of particle size and void fraction distribution and with a reasonably level upper surface.

It was found upon forming a retort generally in accordance with the description in U.S. patent application Ser. No. 929,250 that the fragmented mass of particles in the retort did not completely fill the retort cavity, that is, a void space remained between the upper surface of the fragmented mass and overlying unfragmented formation. In addition, a tendency was noted for the fragmented mass in the retort to form a mound, that is, the upper surface of the fragmented mass was relatively high near the middle of the retort and was relatively low nearer the side boundaries. It is desirable to avoid such mounding in an in situ oil shale retort.

It was also found that an appreciable quantity of formation particles from the fragmented mass entered the access drifts to the voids excavated within the boundaries of the retort site. It is believed that this tended to increase void fraction in adjacent portions of the fragmented mass and may have aggravated the tendency to form a mound in the fragmented mass. It is believed that at least a portion of the fragmented formation in the access drifts was from a zone of formation explosively expanded from above the respective void. Such formation may have moved into such a drift under the influence of gravity subsequent to explosive expansion. Such movement could increase void fraction in adjacent portions of the fragmented mass. It is therefore desirable to minimize the effect of access drifts through side boundaries of the retort.

BRIEF SUMMARY

A method is provided in practice of this invention for forming an in situ oil shale retort in a subterranean formation containing oil shale. At least one horizontally extending void is excavated within the boundaries of an in situ oil shale retort site, leaving a zone of unfragmented formation above and/or below such a void. At least one pillar of unfragmented formation is left within the side boundaries of such a void for providing temporary support for overlying formation. Such a pillar is explosively expanded so that a principal portion of the pillar fragments travel to side boundaries of the retort. Such a zone of unfragmented formation is then explosively expanded towards the void for forming a fragmented permeable mass of formation particles in the retort. By accumulating sufficient pillar fragments adjacent side boundaries of the retort any tendency to form a mound upon explosive expansion of the zone of unfragmented formation can be substantially offset, resulting in a fragmented mass in the retort with a reasonably flat upper surface.

DRAWINGS

These and other features and advantages of the present invention will be appreciated as the same becomes better understood by reference to the following detailed description when considered in connection with the accompanying drawings wherein.

DESCRIPTION

Figure 1:
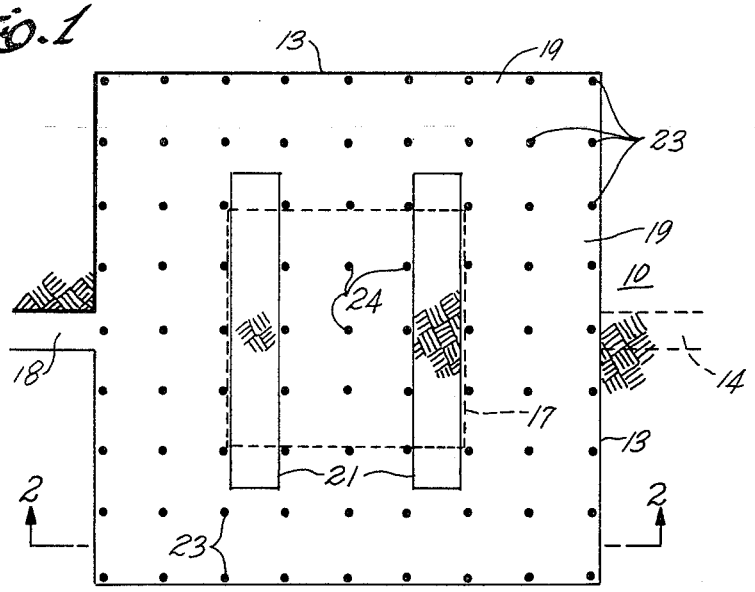
FIG. 1 is a semi-schematic horizontal cross section through an in situ oil shale retort site at an intermediate stage during formation of a retort.
Figure 2:
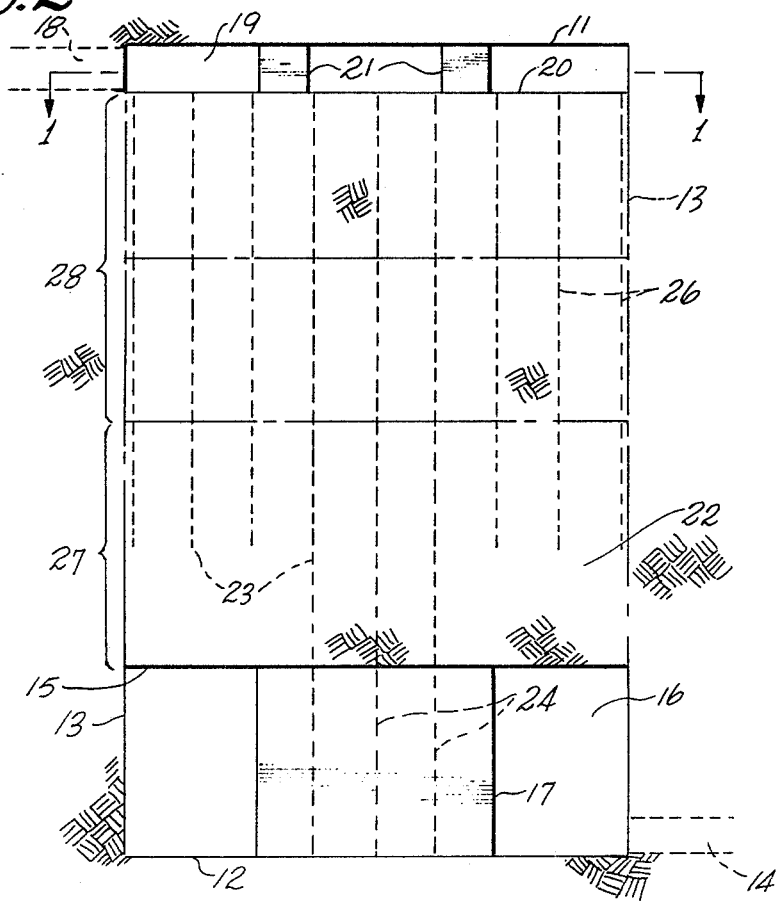
FIG. 2 is a semi-schematic vertical cross section through the retort site at line 2—2 in FIG. 1.

FIGS. 1 and 2 are horizontal and vertical cross sections, respectively, of an in situ oil shale retort site after excavation of voids to provide void volume in an in situ oil shale retort and before explosive expansion of formation to form such a retort. The retort site is in a subterranean formation 10 and has an upper boundary 11, a lower boundary 12, and side boundaries 13. In the illustrated embodiment, the retort has a square horizontal cross section, however, it will be understood that an unequal rectangular cross section or other cross section is suitable, and that a square cross section is illustrated solely for convenience.

In this embodiment a horizontally extending access drift 14 or the like is excavated through subterranean formation to a side boundary of the retort site at its lower level. A void 16 is excavated at this lower or production level via the access drift. The production level void extends horizontally across the retort site and has side boundaries substantially coinciding with the side boundaries 13 of the retort. The production level void is in the order of 20 to 25% of the total height of the retort between the lower boundary 12 and the upper boundary 11. Overlying unfragmented formation above the void has a horizontal free face 15 at the top of the void.

A large support pillar 17 of unfragmented formation is left within the void for temporarily supporting overlying formation or overburden above the production level void. In the illustrated embodiment the pillar is square in horizontal cross section and is somewhat wider than the height of the production level void. The pillar occupies about 20% of the horizontal cross-sectional area of the void; that is, at the production level there is an extraction ratio of about 80%.

An upper or air level drift 18 is excavated through a side boundary of the retort site near its upper boundary 11. The air level drift provides access to the retort site for excavation of an upper or air level void 19. The air level void extends horizontally across the retort site and has side boundaries substantially coinciding with the side boundaries 13 of the retort. A pair of air level pillars 21 of unfragmented formation are left within the air level void for temporary support of the overlying formation or overburden. In the illustrated embodiment the air level pillars 21 are long rectangular pillars located within the air level void so that effective access is provided to substantially the entire horizontal cross section of the retort site for drilling and loading blast holes, for example.

A thick zone 22 of unfragmented formation is left within the boundaries of the retort site between the upper air level void 19 and the lower production level void 16. In one example the zone 22 of unfragmented formation can occupy about 70% of the total retort height. The top of the zone has a free face 20 at the floor of the air level void.

To form an in situ oil shale retort, the pillars 17 and 21 in both voids are explosively expanded and the zone 22 of unfragmented formation between the voids is explosively expanded toward the voids to form a fragmented permeable mass of particles. The volume provided by the excavated voids provides the void space between particles in the fragmented mass and the average void fraction in the fragmented mass is substantially determined by the available volume of the excavated voids. Thus, for example, when the total excavated volume of the two voids is about 25% of the total volume of the retort site, the resulting fragmented mass has an average void fraction of about 25%.

A plurality of vertical blast holes or shot holes 23 are drilled downwardly from the air level void into the zone 22 of unfragmented formation. In the illustrated embodiment such blast holes are in a square array, however, it will be apparent that other arrays are suitable. A portion 24 of the blast holes are drilled completely through the zone of formation between the upper and lower voids and through the support pillar 17 in the lower production level void. The balance of the blast holes 26 are drilled most of the way through the intervening zone 22.

Horizontal blast holes (not shown) are also drilled in the air level pillars 21. If desired, additional vertical blast holes can be drilled through the lower level pillar 17 or horizontal shot holes can be drilled in the lower level pillar. Columnar explosive charges (not shown) are placed in such blast holes for explosively expanding the pillar and zone of formation 22 between the two voids. Thus, for example, the portion of the longer blast holes 24 within the production level pillar 17 is loaded with explosive. Similarly explosive charges are loaded in blastholes (not shown) in the air level pillars 21 and in the blastholes 23 in the zone of formation between the voids.

The unfragmented formation 22 between the upper and lower voids is explosively expanded in two stages. In a first stage, a lower zone 27 is explosively expanded downwardly toward the underlying production level void 16. In a second stage an upper zone 28 is explosively expanded both upwardly and downwardly. Roughly half of the upper zone is expanded downwardly towards void space overlying the fragmented mass formed by expansion of the lower zone 27, and roughly half of the upper zone 28 is explosively expanded upwardly towards the overlying air level void 19. These two zones 27 and 28 can be explosively expanded in a single round of explosions, or if desired a substantial time interval can elapse between expansion of the lower zone and expansion of the upper zone 28. The latter arrangement permits loading of explosive charges in the upper zone and in the air level pillars after explosive expansion of the lower level pillar and lower zone. Alternatively, all such explosive charges are loaded in a single operation and detonated in a single round including the production level pillar 17, the lower zone 27, the upper zone 28 and the air level pillars 21.

Explosive charges (not shown) are loaded in the array of vertical blast holes 23 in the upper half of the lower zone 27. Stemming is provided above explosive charges in the longer blastholes 27 in the production level pillar to separate such charges from charges in the upper half of the lower zone 27 of unfragmented formation. Stemming is also provided in blastholes above the explosive charges in the upper half of the lower zone 27.

Another array of explosive charges is loaded in the center half of the upper zone 28, and the upper portions of the blastholes 23 are stemmed. Thus, for example, in an embodiment where the upper zone 28 is about 100 feet thick, the lowermost 25 feet of the blasting holes in that zone are stemmed; a 50 foot long explosive column is placed in the blasting holes; and the upper 25 feet of the blasting holes are stemmed.

Each of the explosive charges is provided with a detonator and booster (not shown) for detonating the respective explosive charge at a selected moment.

The first event in explosive expansion is detonation of explosive charges in the production level pillar 17 which explosively expands the pillar towards the side boundaries of the void. After a selected time interval explosive charges in the lower zone 27 are detonated for explosively expanding the lower zone downwardly towards the production level void. Detonation of the explosive charges in the pillar and in the lower zone is preferably in a single round or continuous series of explosions. It is not necessary that all of the explosive charges be detonated simultaneously and it can be preferable to detonate such charges in sequence for minimizing the quantity of explosive detonated at any instant. In practice of this invention a time interval is provided between detonation of explosive in the production level pillar and detonation of explosive in the overlying zone 27 of unfragmented formation above the void.

The time interval between detonation of explosive in the pillar and in the adjacent zone of unfragmented formation is at least sufficient for a principal portion of the pillar fragments to travel to the side boundaries of the void. As used herein "principal portion" means more than about half. That is, when a principal portion of pillar fragments are near the side boundaries of the retort, a greater amount of such fragments are near the boundaries than are distributed elsewhere across the retort. This permits accumulating sufficient pillar fragments near the side boundaries to substantially offset any tendency to form a mound upon explosive expansion of the adjacent zone of unfragmented formation.

The next event in forming a fragmented permeable mass of particles in the retort involves explosive expansion of the upper zone 28 towards the air level void 19 and void space over the top of the fragmented mass formed by explosive expansion of the production level pillar 17 and lower zone 27. Explosive charges in the air level pillars 21 are detonated for explosively expanding the pillars. After a sufficient time interval for a principal portion of the pillar fragments to travel to the side boundaries of the void, explosive is detonated in the upper zone 28. This causes explosive expansion of roughly the lower half of this zone downwardly towards void space over the underlying fragmented mass and roughly the upper half of the zone towards the overlying air level void.

Aforementioned U.S. Pat. No. 4,153,298 states that a useful time interval can permit particles formed by explosive expansion of the pillar to spread substantially uniformly across at least a portion of the void. In practice of this invention, however, it is preferred to have at least a sufficient time interval between detonation of explosive in the pillar and detonation of explosive in the zone of unfragmented formation for a principal portion of the pillar fragments to travel to the side boundaries of the void. The amount of explosive in the pillar is sufficient to eject a principal portion of fragments of the pillar to at least the side boundaries of the void.

It is not essential that such fragments actually reach the side boundary before detonation of explosive in the adjacent zone. The dynamics of explosive expansion are such that fragments of the pillar in motion can continue in motion towards the side boundaries after detonation of explosive in the adjacent zone until stopped by expansion of formation. In some embodiments it is preferable that the pillar fragments have not yet come to rest on the bottom of the void at the time of detonation of explosive in the adjacent zone. Thus, explosive in the zone or zones of unfragmented formation adjacent the void is detonated while a substantial portion of the pillar fragments are still in mid-air.

Initiating the expansion of formation from the adjacent zone toward the void before the pillar particles come to rest is particularly advantageous when underlying formation is being expanded upwardly toward the void as hereinafter described. When the pillar fragments are permitted to come to rest on the free face of the underlying formation, they can interfere with expansion of underlying formation in two ways.

First, when explosive is detonated in the underlying formation, a compression wave travels through the formation to the free face adjoining the void. At the free face the compression wave is reflected back into the formation as a tension wave which initiates spalling and fragmentation at the free face. The stress wave is reflected because of a mismatch of properties at the free face. For example, the wave velocity in unfragmented formation is much different from wave velocity in air. When pillar fragments are on the free face the mismatch can be decreased and less energy is reflected. In other words, pillar fragments resting on the free face absorb part of the compression wave, thereby lessening the intensity of the tension wave and consequently the extent of fracturing obtained.

Second, the pillar fragments must be lifted by the expanding underlying formation, thus lessening the energy available for expansion of formation. As a result, significantly greater quantities of explosive can be required to effect expansion of the underlying formation than would be required in the absence of fragments resting on the free face. Thus, by expanding underlying fragmented formation before fragments formed by explosive expansion of pillars have come to rest, more efficent use of explosive and greater uniformity of void fraction in the resulting fragmented mass can be achieved.

Preferably, the time interval between detonation of explosive in the pillar and detonation of explosive in the adjacent zone is at least about one-half second. In some embodiments the time interval can be many times longer. If the interval is less than about one-half second there may not be time for a principal portion of the pillar fragments to accelerate and travel to the side boundaries of the void before being stopped by explosive expansion of formation from an adjacent zone of unfragmented formation.

A nominal velocity for a principal portion of fragments explosively expanded from a pillar is about 100 feet per second. In an exemplary void about 165 feet square having a 75 foot square pillar centered in the void, the average distance a pillar fragment must travel to reach the side boundary of the void is in the order of 65 feet. Thus, a principal portion of the pillar fragments can travel to the side boundaries of the retort in somewhat over 650 milliseconds. Detonation of explosive in an adjacent zone of unfragmented formation should therefore be at least about one-half second after detonation of explosive in the pillars, recognizing that some time is required for fragments from the adjacent zone to inhibit travel of pillar fragments and that in an embodiment where pillars are closer to the side boundaries of the void there is a shorter average travel time to the side boundaries of the void for a principal portion of the pillar fragments.

In an embodiment as illustrated in FIGS. 1 and 2 the time interval for explosive expansion of the production level pillar 17 can be appreciably longer than one-half second. This is the case since the zone 27 of unfragmented formation above the void is explosively expanded downwardly and there is no upward expansion of formation from below the void. Thus a substantial portion of the fragments from the pillar can come to rest on the floor of the void without interfering with explosive expansion of the adjacent zone of unfragmented formation.

With an appreciable time interval the pillar fragments form a generally concave permeable mass relatively deeper along the side boundaries of the void and relatively shallower nearer the middle of the void. The same general effect can be obtained with a time interval as short as about one-half second between detonation of explosive in the pillar and detonation of explosive in the adjacent zone of unfragmented formation.

The concave permeable mass of pillar fragments formed by explosively expanding a pillar an appreciable time interval before explosively expanding an adjacent zone of unfragmented formation can substantially offset a tendency for explosive expansion of such a zone of form a convex mound. It appears that explosively expanding a zone of formation towards a horizontal free face within the side boundaries of an in situ oil shale retort tends to eject fragments somewhat preferentially towards the middle of the retort. This effect is substantially offset by timing explosive expansion of the pillars for ejecting fragments sufficiently early for travel to the side boundaries of the horizontally extending void.

This effect is obtained when a zone of unfragmented formation is explosively expanded upwardly towards such a void because the pillar fragments essentially fill the depressed edges of the mound formed by explosive expansion of the underlying zone. The effect is obtained when an overlying zone is expanded downwardly because the pillar fragments tend to support edge portions of the overlying fragmented mass. When zones of unfragmented formation are explosively expanded both upwardly and downwardly towards such a void a combination of these effects is obtained.

A tendency for the fragmented mass formed upon explosive expansion of the upper zone to mound in the center is offset by an accumulation of pillar fragments near the side boundaries of the upper air level void, and in some embodiments by concavity in the upper surface of the fragmented mass formed in the lower portion of the retort. Such concavity can result when the accumulation of pillar fragments near the side boundaries of the lower void more than compensates for a tendency towards mounding during explosive expansion of the lower zone. In addition there are suggestions that the tendency towards mounding is more pronounced upon downward explosive expansion towards an underlying void than upon upward expansion towards an overlying void. In that event offsetting of mounding by the lower level pillar 17, which has a larger volume than the upper level pillars 21, can be significant.

In addition, a time interval somewhat longer than about one-half second can permit a substantial portion of pillar fragments to enter the production level drift 14. Such fragments can fill a principal portion of the cross section of the drift near the side boundary of the void and inhibit movement of particles from the adjacent zone of unfragmented formation into the drift upon explosive expansion of that zone. This effect can help minimize non-uniformity in void fraction distribution in the fragmented mass near such drifts.

It will be apparent that filling a principal portion of the cross section of an access drift near the side boundary of a void with pillar fragments is significant for a drift appreciably below the upper surface of the fragmented mass. Movement of particles into a drift appreciably below the upper surface can cause a high void fraction region a substantial distance above such a drift. A drift at the upper surface, however, has only a localized influence. It is, therefore, of more significance in an embodiment as illustrated in FIGS. 1 and 2 to fill a principal portion of the cross section of the production level drift 14 than to have pillar fragments in the air level drift 18.

Figure 3:
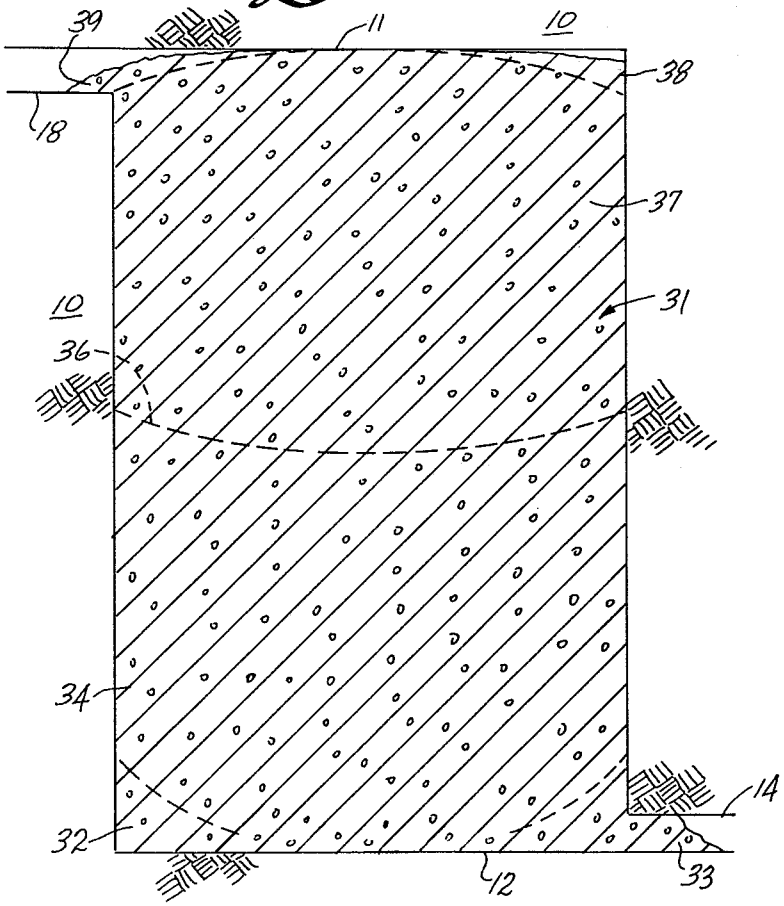
FIG. 3 is a semi-schematic vertical cross section through the in situ oil shale retort after explosive expansion to form a fragmented mass of formation particles in the retort.

FIG. 3 illustrates in vertical cross section the in situ oil shale retort after explosive expansion for forming a fragmented mass 31 of formation particles in the retort. Various portions of the fragmented mass are formed by explosive expansion of the pillars and zones hereinabove described and illustrated in FIGS. 1 and 2. Thus, near the lower boundary 12 of the retort there is a portion 32 of the fragmented mass largely made up of particles from the pillar 17 at the production level. The upper boundary of this portion of the fragmented mass is generally concave with the height being greater near the edges of the retort than near the middle. This portion can have a void fraction somewhat higher than the average void fraction in the fragmented mass due to early explosive expansion. Some of the fragmented mass formed of pillar fragments 33 substantially fills the cross section of the production level drift 14 near the side boundary of the retort.

Overlying the lower part of the fragmented mass from the production level pillar and occupying roughly half the retort height is a portion 34 largely made up of fragments from the lower zone 27. Although there is a tendency for the fragmented mass formed from this zone to mound or have a convex upper boundary this tendency can be more than offset by the concave upper boundary of the fragments from the pillar. Thus, the upper boundary 36 of this portion of the fragmented mass can be slightly concave or may be nearly flat.

The balance of the retort cavity is substantially filled with an upper portion 37 of the fragmented mass from the upper zone 28. By explosively expanding the upper level pillars 21 a substantial time interval before expanding the upper zone a portion 38 near the side boundaries of the retort can be occupied by pillar fragments. This tends to offset a tendency to mound upon explosive expansion of the upper zone and can produce a reasonably flat upper surface on the fragmented mass in the retort. It may be noted that the fragmented mass in the retort may not be tightly against the upper boundary 11 of unfragmented formation throughout the horizontal cross section of the retort. Any open space occurring in this region can be small and reasonably uniform because of the substantially flat upper surface of the fragmented mass in the retort.

A small amount 39 of the fragmented mass can be in the air level drift 18 due in large part to travel of pillar fragments into the drift, thereby substantially filling the cross section of the drift near the side boundary of the retort.

Figure 4:
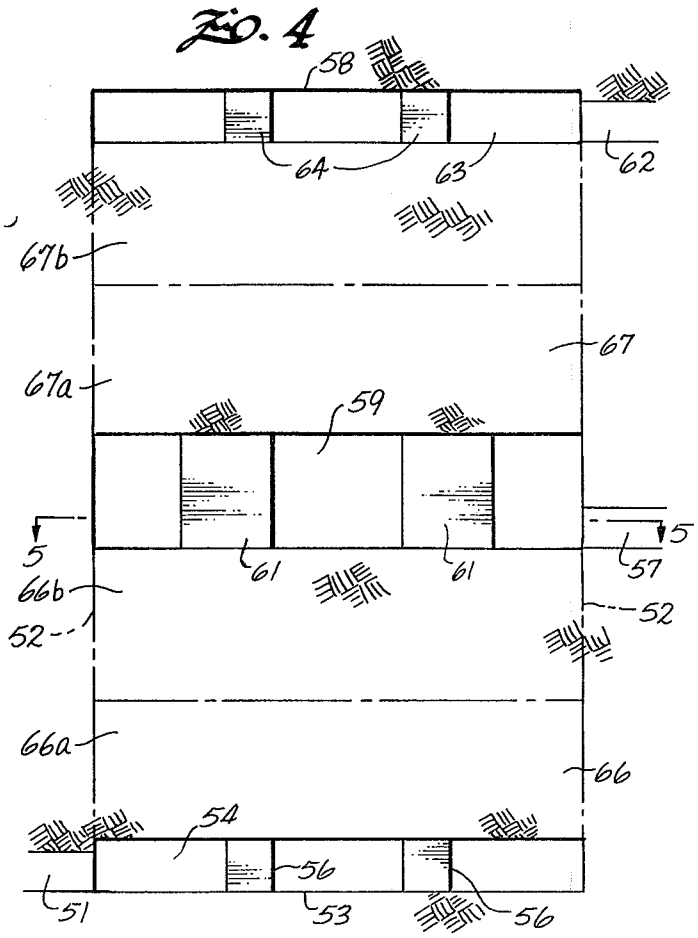
FIG. 4 is a semi-schematic vertical cross section through another embodiment of in situ oil shale retort at an intermediate stage of formation according to principles of this invention.
Figure 5:
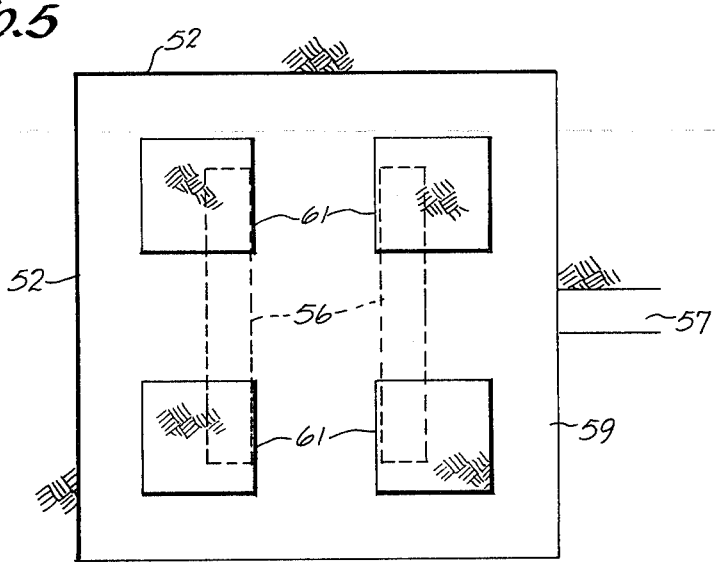
FIG. 5 is a semi-schematic horizontal cross section through the retort of FIG. 4 at line 5—5.

FIGS. 4 and 5 illustrate in vertical and horizontal cross section, respectively, an in situ oil shale retort site after excavation of voids within the boundaries of the retort and before explosive expansion. A lower production level access drift 51 is excavated to a side boundary 52 of the retort site near the lower boundary 53. A horizontally extending production level void 54 is excavated at the lower boundary of the retort via the access shift 51. The side boundaries of the production level void substantially coincide with the side boundaries 52 of the retort. A pair of relatively long narrow support pillars 56 of unfragmented formation are left within the side boundaries of the production level void for supporting overlying formation.

An intermediate level access drift 57 is excavated to a side boundary of the retort site roughly halfway between the lower boundary 52 and upper boundary 58 of the retort. An intermediate level void 59 is excavated via the intermediate level access drift 57. The intermediate level void extends horizontally across the retort site and its side boundaries coincide substantially with the side boundaries of the retort being formed. Four square pillars 61 of unfragmented formation are left in the intermediate void 59 for temporary support of overlying formation. In the illustrated embodiment each of the four pillars 61 is centrally located in a quadrant of the intermediate level void. Collectively the intermediate level pillars 61 occupy about 20% of the horizontal cross-sectional area of the retort site. Thus, the extraction ratio at the intermediate level void is about 80%.

An air level access drift 62 is excavated to a side boundary of the retort site near the upper boundary 58. From this drift an upper horizontally extending void 63 is excavated with side boundaries substantially coinciding with side boundaries of the retort being formed. A pair of elongated pillars 64 of unfragmented formation are left in the air level void for support of overlying formation. The air level pillars 64 can be similar to the production level pillars 56 and are arranged in the air level void to provide effective access to substantially the entire horizontal cross-sectional area of the retort site for drilling and loading of blasting holes and the like. Excavation of the upper, intermediate, the lower voids in the retort site leaves a lower zone 66 of unfragmented formation between the lower void and the intermediate void, and an upper zone 67 of unfragmented formation between the intermediate void and the upper void. Such zones of unfragmented formation are explosively expanded towards the free faces adjacent the voids for forming a fragmented mass of formation particles in the retort.

Blastholes (not shown) are drilled and loaded with explosive in preparation for explosive expansion of unfragmented formation to form a fragmented mass of particles in the retort. Thus, horizontal blastholes are drilled in the lower level pillars 56 and upper level pillars 64 for explosive expansion thereof. Either vertical or horizontal, preferably horizontal, blastholes are drilled in the intermediate level pillars 61. Vertical blastholes are drilled in the upper and lower zones 66 and 67 and the portion of each such hole in the middle half of each such zone is loaded with explosive. Explosive charges are also loaded into the blastholes in the pillars. Preferably the explosive in the pillars and two zones of unfragmented formation are detonated in a single round with suitable short time delays within the round. Alternatively, if desired the lower zone 66 of unfragmented formation can be explosively expanded before the upper zone 67.

Explosive is first detonated in the lower level pillars 56 and/or intermediate level pillars 61 for explosively expanding such pillars toward the surrounding void. The upper level pillars 64 can be explosively expanded at the same time or somewhat later.

After a time interval sufficient for a principal portion of the pillar fragments to travel to the side boundaries of the respective void, explosive is detonated in the lower zone 66 of unfragmented formation. Explosive can also be detonated in the upper zone 67 at about the same time or somewhat thereafter.

Upon detonation of the explosive roughly half 66*a* of the lower zone expands downwardly toward the production level void 54 and roughly half 66*b* expands upwardly toward the intermediate void 69. Similarly roughly half of the upper zone 67*a* expands downwardly towards the intermediate void 59 and the other half 67*b* expands upwardly towards the overlying air level void 63.

Each half of these zones of unfragmented formation can be considered a zone expanding towards its respective void. Thus, a zone 66*a* above the lower void is expanded downwardly toward the void. An uppermost zone 67*b* below the air level void expands upwardly towards the void. Two zones 66*b* below the intermediate void and 67*a* above the intermediate void, both explosively expand towards the intermediate void. To accommodate such expansion and assure reasonably uniform void fraction distribution in the resulting fragmented mass, the volume excavated from intermediate level void is approximately twice the volume excavated from either the upper or lower level void.

Thus, each of the excavated voids has at least one zone of unfragmented formation above and/or below the void for explosive expansion towards that void. Just as in the embodiment hereinabove described the pillars in the voids are explosively expanded so that a principal portion of the fragments of the pillar travel to the side boundaries of the void, thereby substantially offsetting a tendency to form a mound upon explosive expansion of such a zone of unfragmented formation towards the adjacent horizontal free face.

It might be noted that the region of the fragmented mass (not shown) resulting from explosive expansion of the intermediate level pillars 61 can have concave upper and lower boundaries in an embodiment as illustrated in FIGS. 4 and 5.

Figure 6:
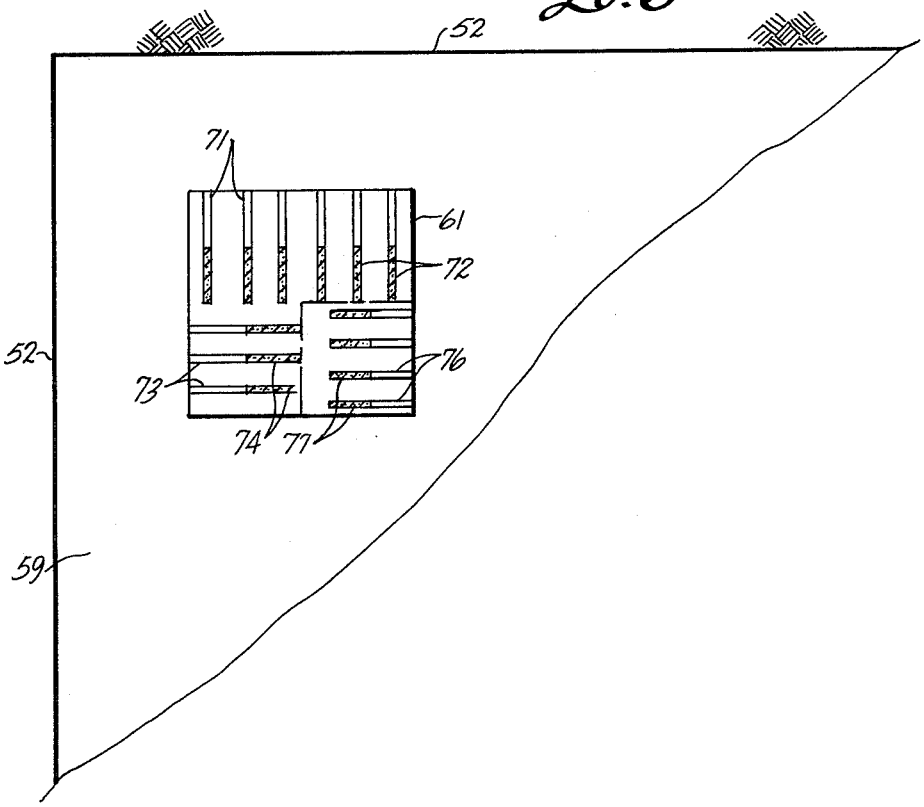
FIG. 6 is a fragmentary semi-schematic horizontal cross section enlarging a portion of the cross section of FIG. 5.

FIG. 6 illustrates in fragmentary horizontal cross section one of the pillars 61 in the intermediate level void of the retort illustrated in FIGS. 4 and 5. This drawing indicates semi-schematically an arrangement of explosive charges in such a pillar for preferentially explosively expanding of a principal portion of the pillar fragments towards the side boundaries of the retort. Without such an arrangement fragments from each pillar could be more or less uniformly ejected in all directions and preferential accumulation of fragments near the side boundaries of the retort might not occur.

As illustrated in this embodiment a plurality of horizontal blastholes are drilled in the pillar with such blastholes at one elevation in the pillar indicated in the drawing. The diameters of the blastholes are exaggerated in the drawing for purposes of illustration. A first array of blastholes 71 are drilled in a face of the pillar opposite a side boundary 52 of the void. These blastholes are drilled about half the thickness of the pillar and occupy two quadrants of the pillar. An explosive charge 72 is loaded in the bottom half off each of these blastholes and the balance of each hole is stemmed. A second array of blastholes 73 is drilled in the other face of the pillar adjacent a side boundary 52 of the retort. These blastholes are also drilled about half the thickness of the pillar and occupy a quadrant of the pillar. An explosive charge 74 is loaded into the bottom half of each of the blastholes 73, and the balance of each hole is stemmed. A third array of blastholes 76 is drilled in the remaining quadrant of the pillar. Explosive charges 77 are placed in these blasting holes with each columnar charge approximately centered on a mid plane through the quadrant.

The explosive charges 72 and 74 in the three outer quadrants of the pillar are detonated first. After a short time delay, e.g., up to about 100 milliseconds, the explosive charges 77 in the remaining quadrant of the pillar are detonated. Such decking of the explosive charges in the pillar tends to eject pillar fragments from the three outer quadrants of the pillar preferentially towards the side boundaries 52 of the void. Fragments from the remaining quadrant of the pillar are more or less uniformly ejected by the explosive charges 77. Such an arrangement and others which will be apparent to those skilled in the art promote explosive expansion of a principal portion of the pillar fragments towards the side boundary of the void.

The pillars 56 and 64 in the lower and upper voids, respectively, or the pillars hereinabove described and illustrated in FIGS. 1 and 2, can also be explosively expanded with decked explosive charges for preferentially ejecting a principal portion of the pillar fragments towards the side boundaries of the respective void. A variety of arrays of explosive charges and timing for ejecting a principal portion of the pillar fragments towards the side boundaries of the void employing principles such as those described and illustrated in FIG. 6 will be apparent to those skilled in the art.

Although the method for forming an in situ oil shale retort has been described and illustrated in two embodiments, many modifications and variations will be apparent to one skilled in the art. Thus, other arrangements wherein a horizontally extending void is excavated, leaving a zone of unfragmented formation above and/or below such a void are contemplated, such as an arrangement having plural intermediate voids as described and illustrated in U.S. patent application Ser. No. 929,250. Other arrangements of explosive charges for expansion of pillars and/or zones of unfragmented formation above and/or below such voids will be apparent. Thus, for example, decking of charges of explosive in a zone of unfragmented formation can be employed as described in U.S. Pat. No. 4,146,272. A variety of techniques for blasting pillars are disclosed in U.S. patent application Ser. No. 075,810, entitled METHOD OF RUBBLING A PILLAR, Filed Sept. 14, 1979, by Thomas E. Ricketts. The patent and application are incorporated herein by reference. Since many such variations and modifications are contemplated, this invention should not be limited except as recited in the following claims.

What is claimed is:

1. A method for forming an in situ oil shale retort in a retort site in a subterranean formation containing oil shale, the in situ oil shale retort containing a fragmented permeable mass of formation particles within the boundaries of the retort comprising the steps of:

excavating at least one horizontally extending void within the boundaries of an in situ oil shale retort site leaving zones of unfragmented formation above and below such a void and leaving at least one pillar of unfragmented formation within the side boundaries of such a void for providing temporary support for overlying formation above the void;

placing explosive in such a pillar, the amount of explosive being sufficient to eject a principal portion of fragments of the pillar to at least the side boundaries of the void;

placing explosive in at least one such zone of unfragmented formation;

detonating explosive in the pillar for explosively expanding the pillar and ejecting pillar fragments towards side boundaries of the void; and detonating explosive in such a zone of unfragmented formation for explosively expanding the zone towards the void, the time interval between detonation of explosive in the pillar and detonation of explosive in the zone being at least sufficient for a principal portion of the pillar fragments to travel to the side boundaries of the void.

2. A method as recited in claim 1 wherein the time interval between detonation of explosive in the pillar and detonation of explosive in the zone is at least about one-half second.

3. A method as recited in claim 2 wherein the time interval is sufficiently short that a substantial portion of fragments formed by explosive expansion of the pillar have not come to rest before detonation of explosive in the zone.

4. A method as recited in claim 1 wherein such a zone of unfragmented formation is below such a void and is explosively expanded upwardly towards the void, and wherein the time interval is sufficiently short that a principal portion of fragments ejected from the pillar remain in motion at the time of detonation of explosive in the zone of unfragmented formation.

5. A method as recited in claim 1 wherein a subterranean drift is in communication with the void through a side boundary and the time interval is sufficiently long for filling a principal portion of the cross section of the drift near the side boundary with fragments ejected from the pillar.

6. A method as recited in claim 1 wherein such a zone of unfragmented formation is above such a void and is explosively expanded downwardly towards the void, and wherein the time interval is long enough for forming a generally concave permeable mass of pillar fragments in the retort.

7. A method for forming an in situ oil shale retort in a retort site in a subterranean formation containing oil shale, the in situ oil shale retort containing a fragmented permeable mass of formation particles within the boundaries of the retort comprising the steps of:

excavating at least one horizontally extending void within the boundaries of an in situ oil shale retort site leaving zones of unfragmented formation above and below such a void and leaving at least one pillar of unfragmented formation within the side boundaries of such a void for providing temporary support for overlying formation above the void;

placing explosive in such a pillar, the amount of explosive being sufficient to eject a principal portion of fragments of the pillar to at least the side boundaries of the void;

placing explosive in at least one such zone of unfragmented formation;

detonating a first portion of explosive in the pillar for preferentially explosively expanding a portion of the pillar and ejecting pillar fragments towards at least one adjacent side boundary of the void and thereafter detonating another portion of explosive in the pillar for explosively expanding the balance of the pillar towards side boundaries of the void; and detonating explosive in such a zone of unfragmented formation for explosively expanding the zone towards the void, the time interval between detonation of explosive in the pillar and detonation of explosive in the zone being at least sufficient for a principal portion of the pillar fragments to travel to the side boundaries of the void.

8. A method for forming an in situ oil shale retort in a retort site in a subterranean formation containing oil shale, the in situ oil shale retort containing a fragmented permeable mass of formation particles within boundaries of the retort comprising the steps of:

excavating at least one horizontally extending void within the boundaries of an in situ oil shale retort leaving zones of unfragmented formation above and below such a void and leaving at least one pillar of unfragmented formation within the side boundaries of such a void for providing temporary support for overlying formation above the void;

explosively expanding such a pillar so that a principal portion of the fragments of the pillar travel to side boundaries cf the void; and explosively expanding at least one such zone of unfragmented formation towards the void for forming a fragmented permeable mass of particles in the retort.

9. A method as recited in claim 8 wherein such a zone is above the void and is explosively expanded downwardly towards the void.

10. A method as recited in claim 9 wherein such a zone is below the void and is explosively expanded upwardly towards the void before a principal portion of fragments formed by explosive expansion of such a pillar have come to rest.

11. A method as recited in claim 8 wherein such a zone of unfragmented formation is explosively expanded at least about one-half second after explosive expansion of such a pillar.

12. A method as recited in claim 8 wherein such a zone is below the void and is explosively expanded upwardly towards the void before a principal portion of fragments formed by explosive expansion of such a pillar have come to rest.

13. A method for forming an in situ oil shale retort in a retort site in a subterranean formation containing oil shale, the in situ oil shale retort containing a fragmented permeable mass of formation particles within boundaries of the retort comprising the steps of:

excavating at least one horizontally extending void within the boundaries of an in situ oil shale retort leaving zones of unfragmented formation above and below such a void and leaving at least one pillar of unfragmented formation within the side boundaries of such a void for providing temporary support for overlying formation above the void;

explosively expanding a first portion of such a pillar preferentially towards at least one adjacent side boundary of the void and thereafter explosively expanding the balance of the pillar so that a principal portion of the fragments of the pillar travel to portions of the retort site adjacent to side boundaries of the void; and explosively expanding at least one such zone of unfragmented formation towards the void for forming a fragmented permeable mass of particles in the retort.

14. A method for forming an in situ oil shale retort in a retort site in a subterranean formation containing oil shale, the in situ oil shale retort containing a fragmented permeable mass of formation particles within the boundaries of the retort comprising the steps of:

excavating at least one horizontally extending void within the boundaries of an in situ oil shale retort site, leaving a zone of unfragmented formation above and/or below such a void and leaving at least one pillar of unfragmented formation within the side boundaries of such a void for providing temporary support for overlying formation above the void;

explosively expanding such a pillar for forming a generally concave permeable mass of pillar fragments; and explosively expanding such a zone of unfragmented formation towards such a void for forming a fragmented permeable mass of particles in the retort.

15. A method as recited in claim 14 wherein such a zone is above the void and is explosively expanded downwardly towards the void.

16. A method as recited in claim 14 wherein such a zone is below the void and is explosively expanded upwardly towards the void before a principal portion of fragments formed by explosive expansion of such a pillar have come to rest.

17. A method as recited in claim 14 wherein a subterranean drift is in communication with the void through a side boundary and the time interval between explosive expansion of such a pillar and explosive expansion of the zone of unfragmented formation is long enough for filling a principal portion of the cross section of the drift near the side boundary with fragments ejected from the pillar.

18. A method as recited in claim 14 wherein such a pillar is explosively expanded for preferentially ejecting a principal portion of pillar fragments towards at least one side boundary of the retort.

19. A method as recited in claim 14 wherein such a zone of unfragmented formation is explosively expanded at least about one-half second after explosive expansion of such a pillar.

20. A method for forming an in situ oil shale retort in a retort site in a subterranean formation containing oil shale, the in situ oil shale retort containing a fragmented permeable mass of formation particles within the boundaries of the retort, comprising the steps of:

excavating at least one horizontally extending void within the boundaries of an in situ oil shale retort site, leaving zones of unfragmented formation above and below such a void and leaving at least one pillar of unfragmented formation within the side boundaries of such a void for providing temporary support for overlying formation above the void;

placing explosive in such a pillar;

placing explosive in at least one such zone of unfragmented formation;

detonating explosive in the pillar for explosively expanding the pillar and ejecting pillar fragments toward side boundaries of the void; and at least about one-half second after detonating explosive in the pillar, detonating explosive in such a zone of unfragmented formation for explosively expanding the zone towards the void.

21. A method as recited in claim 20 wherein the time interval between detonation of explosive in the pillar and detonation of explosive in the zone is sufficiently short that a principal portion of fragments ejected from the pillar remain in motion at the time of detonation of explosive in the zone of unfragmented formation.

22. A method as recited in claim 20 wherein a subterranean drift is in communication with the void through a side boundary and the time interval between detonation of explosive in the pillar and detonation of explosive in the zone of unfragmented formation is sufficiently long for filling a principal portion of the cross section of the drift near the side boundary with fragments ejected from the pillar.

23. A method as recited in claim 20 wherein such a zone is above the void and is explosively expanded downwardly towards the void.

24. A method for forming an in situ oil shale retort in a retort site in a subterranean formation containing oil shale, the in situ oil shale retort containing a fragmented permeable mass of formation particles within the boundaries of the retort, comprising the steps of:

excavating at least one horizontally extending void within the boundaries of an in situ oil shale retort site, leaving zones of unfragmented formation above and below such a void and leaving at least one pillar of unfragmented formation within the side boundaries of such a void for providing temporary support for overlying formation above the void;

placing explosive in such a pillar;

placing explosive in at least one such zone of unfragmented formation;

detonating a first portion of explosive in the pillar for preferentially explosively expanding a portion of the pillar towards at least one side boundary of the void and thereafter detonating another portion of explosive in the pillar for explosively expanding the balance of the pillar and ejecting pillar fragments toward side boundaries of the void; and at least about one-half second after detonating explosive in the pillar, detonating explosive in such a zone of unfragmented formation for explosively expanding the zone towards the void.

25. A method for forming an in situ oil shale retort in a retort site in a subterranean formation containing oil shale, the in situ oil shale retort containing a fragmented permeable mass of formation particles within the boundaries of the retort comprising the steps of:

excavating at least one horizontally extending void within the boundaries of an in situ oil shale retort site, leaving zones of unfragmented formation above and below such a void and leaving at least one pillar of unfragmented formation within the side boundaries of such a void for providing temporary support for overlying formation above the void;

explosively expanding such a pillar for forming a fragmented permeable mass of particles from the pillar; and explosively expanding such a zone of unfragmented formation towards such a void for forming a fragmented permeable mass of particles in the retort wherein such pillar is explosively expanded a sufficient time before explosive expansion of such zone of unfragmented formation that the fragmented mass of particles from the pillar is thicker near at least one side boundary of the retort than it is near the center of the retort.

26. A method as recited in claim 25 wherein particles from the pillar are on top of at least a portion of the fragmented mass of particles formed by explosively expanding such a zone of unfragmented formation.

27. A method as recited in claim 25 wherein particles from the pillar are beneath at least a portion of the fragmented mass formed by explosively expanding such a zone of unfragmented formation.

28. A method as recited in claim 25 wherein such a zone is above the void and is explosively expanded downwardly towards the void.

29. A method as recited in claim 25 wherein such a zone is below the void and is explosively expanded upwardly towards the void before a principal portion of particles formed by explosive expansion of such a pillar have come to rest.

30. A method as recited in claim 25 wherein a subterranean drift is in communication with the void through a side boundary and the time interval between explosive expansion of such a pillar and explosive expansion of the zone of unfragmented formation is long enough for filling a principal portion of the cross section of the drift near the side boundary with particles ejected from the pillar.

31. A method as recited in claim 25 wherein such a pillar is explosively expanded for preferentially ejecting a principal portion of pillar fragments towards at least one adjacent side boundary of the retort.

32. A method as recited in claim 25 comprising explosively expanding a first portion of such a pillar preferentially towards an adjacent side boundary of the void and thereafter explosively expanding the balance of the pillar.

33. A method as recited in claim 25 wherein such a zone of unfragmented formation is explosively expanded at least about one-half second after explosive expansion of such a pillar.

34. A method for forming an in situ oil shale retort in a retort site in a subterranean formation containing oil shale, the in situ oil shale retort containing a fragmented permeable mass of formation particles within the boundaries of the retort comprising the steps of:

excavating a subterranean drift through a side boundary of the retort site;

excavating at least one horizontally extending void in communication with the drift within the side boundaries of the retort site, leaving a zone of unfragmented formation above and/or below such a void and leaving at least one pillar of unfragmented formation within the side boundaries of such a void for providing temporary support for overlying formation above the void;

explosively expanding such a pillar for filling a principal portion of the cross section of the drift near the side boundary of the retort site with pillar fragments; and explosively expanding such a zone of unfragmented formation towards the void for forming a fragmented permeable mass of formation particles in the retort.

35. A method as recited in claim 34 wherein such a zone is above the void and is explosively expanded downwardly towards the void.

36. A method as recited in claim 35 wherein such a zone is below the void and is explosively expanded upwardly towards the void before a principal portion of fragments formed by explosive expansion of such a pillar have come to rest.

37. A method as recited in claim 34 wherein such a zone of unfragmented formation is explosively expanded at least about one-half second after explosive expansion of such a pillar.

38. A method for forming an in situ oil shale retort in a retort site in a subterranean formation containing oil shale, the in situ oil shale retort containing a fragmented permeable mass of formation particles within the boundaries of the retort comprising the steps of:

excavating a subterranean drift through a side boundary of the retort site;

excavating at least one horizontally extending void in communication with the drift within the side boundaries of the retort site, leaving a zone of unfragmented formation above and/or below such a void and leaving at least one pillar of unfragmented formation within the side boundaries of such a void for providing temporary support for overlying formation above the void;

explosively expanding a first portion of such a pillar preferentially towards at least one side boundary of the void and thereafter explosively expanding the balance of the pillar for filling a principal portion of the cross section of the drift near the side boundary of the retort site with pillar fragments; and explosively expanding such a zone of unfragmented formation towards the void for forming a fragmented permeable mass of formation particles in the retort.

39. In a method for forming an in situ oil shale retort in a subterranean formation containing oil shale, the in situ oil shale retort containing a fragmented permeable mass of formation particles within the boundaries of the retort, comprising the steps of:

excavating at least one horizontally extending void within the boundaries of an in situ oil shale retort site leaving a zone of unfragmented formation above and/or below such a void and leaving at least one pillar of unfragmented formation within the side boundaries of such a void for providing temporary support for overlying formation above the void; explosively expanding such a pillar; and explosively expanding such a zone of unfragmented formation towards the void for forming a fragmented permeable mass of particles in the retort, the improvement comprising:

providing a sufficient time between explosive expansion of such pillar and explosive expansion of such a zone of unfragmented formation for accumulating sufficient pillar fragments adjacent side boundaries of the retort for substantially offsetting a tendency of fragments of the explosively expanded zone to form a mound, thereby forming a fragmented permeable mass of particles in the retort with a reasonably flat upper surface.

40. A method as recited in claim 39 wherein such a zone is below the void and is explosively expanded upwardly towards the void before a principal portion of fragments formed by explosive expansion of such a pillar have come to rest.

41. A method as recited in claim 39 wherein the pillar fragments are on top of at least a portion of the fragmented mass of particles formed by explosively expanding such a zone of unfragmented formation.

42. A method as recited in claim 39 wherein the pillar fragments are beneath at least a portion of the fragmented mass formed by explosively expanding such a zone of unfragmented formation.

43. A method as recited in any of claims 39, 41 or 42 comprising explosively expanding such a pillar for forming a fragmented mass of particles from the pillar which is thicker near at least one side boundary of the retort than it is near the center of the retort.

44. A method as recited in claim 39 comprising explosively expanding a first portion of such a pillar preferentially towards at least one side boundary of the void and thereafter explosively expanding the balance of the pillar.

* * * * *